US008794782B2

(12) United States Patent
Bushee et al.

(10) Patent No.: US 8,794,782 B2
(45) Date of Patent: Aug. 5, 2014

(54) BATON LIGHT

(76) Inventors: Glenn Bushee, Duxbury, MA (US); Craig P. Starrett, Rindge, NH (US)

( * ) Notice: Subject to any disclaimer, the term of this patent is extended or adjusted under 35 U.S.C. 154(b) by 0 days.

(21) Appl. No.: 13/822,181

(22) PCT Filed: Nov. 12, 2011

(86) PCT No.: PCT/US2011/060494

§ 371 (c)(1),
(2), (4) Date: Mar. 11, 2013

(87) PCT Pub. No.: WO2012/065144

PCT Pub. Date: May 18, 2012

(65) Prior Publication Data

US 2013/0176711 A1 Jul. 11, 2013

Related U.S. Application Data

(60) Provisional application No. 61/456,703, filed on Nov. 12, 2010.

(51) Int. Cl.

| | |
|---|---|
| ***A45B 3/02*** | (2006.01) |
| ***A63B 15/02*** | (2006.01) |
| ***F41B 15/02*** | (2006.01) |
| ***A45B 3/04*** | (2006.01) |
| *F21V 33/00* | (2006.01) |

(52) U.S. Cl.

CPC ..... *A45B 3/04* (2013.01); *F41B 15/027* (2013.01); *F21V 33/0076* (2013.01)

USPC ..... 362/102; 463/47.4; 463/47.7

(58) Field of Classification Search

USPC ..... 362/102; 463/47.4, 47.7

See application file for complete search history.

(56) References Cited

U.S. PATENT DOCUMENTS

| | | | | | |
|---|---|---|---|---|---|
| 5,086,377 | A * | 2/1992 | Roberts | 362/102 |
| 5,287,255 | A | 2/1994 | Strodtman | |
| 5,363,285 | A * | 11/1994 | Wideman | 362/102 |
| D354,328 | S * | 1/1995 | McCarty | D22/117 |
| 5,568,922 | A * | 10/1996 | Siddle | 463/47.7 |
| 5,690,552 | A * | 11/1997 | Siddle | 463/47.7 |
| 5,765,937 | A * | 6/1998 | Shiau | 362/187 |
| 6,238,292 | B1 * | 5/2001 | Pelkey | 463/47.7 |
| 6,350,200 | B2 * | 2/2002 | Starrett et al. | 463/47.2 |
| 6,499,855 | B1 * | 12/2002 | Kukuk | 362/102 |
| 7,004,597 | B2 * | 2/2006 | Kukuk | 362/102 |
| 2001/0002368 | A1 * | 5/2001 | Starrett et al. | 463/47.7 |
| 2002/0159248 | A1 * | 10/2002 | Evenson | 362/102 |
| 2002/0163799 | A1 * | 11/2002 | Kukuk | 362/102 |
| 2007/0019398 | A1 * | 1/2007 | Chen et al. | 362/102 |
| 2010/0276514 | A1 * | 11/2010 | Stethem | 239/289 |

FOREIGN PATENT DOCUMENTS

KR 20-1993-0020173 9/1993

* cited by examiner

*Primary Examiner* — Thomas A Hollweg
(74) *Attorney, Agent, or Firm* — Lawrence J. Shurupoff

(57) ABSTRACT

A lightweight plastic baton includes a hollow cylindrical body which telescopically supports a flexible cylindrical plastic baton shaft. One or more slideways support and concentrically center the baton shaft within the hollow body. A flashlight having a strobed light operating mode is coupled to the baton body to provide a less than lethal deterrent to a potential assailant. A radially movable elastic switch cover is mounted substantially flush with the outer surface of the flashlight to prevent inadvertent actuation of one of several selectable flashlight operating modes.

16 Claims, 8 Drawing Sheets

BATON LIGHT

Metal batons have been used for decades by law enforcement officers to provide a less-than-lethal response to a personal physical threat. In some cases, the physical trauma caused by metal batons has been significant. In order to reduce the potential trauma caused by all-metal batons, a relatively lightweight telescoping plastic baton has been developed in accordance with this disclosure. A relatively large striking tip is provided to distribute striking force over a larger impact area and reduce the chances of severe bone and tissue damage. An all metal baton also creates severe trauma to the officer when used as a defensive tool when blocking a strike from a hard weapon such as a baseball bat or club. The flex in the plastic nylon assembly absorbs the impact of the blow.

To add greater functionality and utility to the plastic baton, a high intensity flashlight has been incorporated into the handle of the baton. The flashlight is provided with a multi-function push-button switch for cycling through and selecting a high intensity light beam, a low intensity light beam or a strobed light beam. The flashlight can serve as both a duty flashlight and as a strobing bright light for temporarily disorienting and blinding an assailant.

By positioning the flashlight on-off and mode selection switch on the handle of the baton, an officer can quickly distract and disorient an assailant with a bright strobing light. If the assailant continues to attack, the officer can quickly deploy the baton without taking attention off the assailant. A simple snap of the wrist is all that is required to extend the shaft of the baton from a retracted flashlight position into an extended striking position. Because the officer need not put away a conventional duty flashlight and then reach for a separate baton, the distraction of switching from a flashlight to a baton is eliminated with the design described in more detail below.

BRIEF DESCRIPTION OF THE DRAWINGS

In the drawings.

In the various views of the drawings, like reference numerals designate like or similar parts.

DETAILED DESCRIPTION OF REPRESENTATIVE EMBODIMENTS

Figure 1:
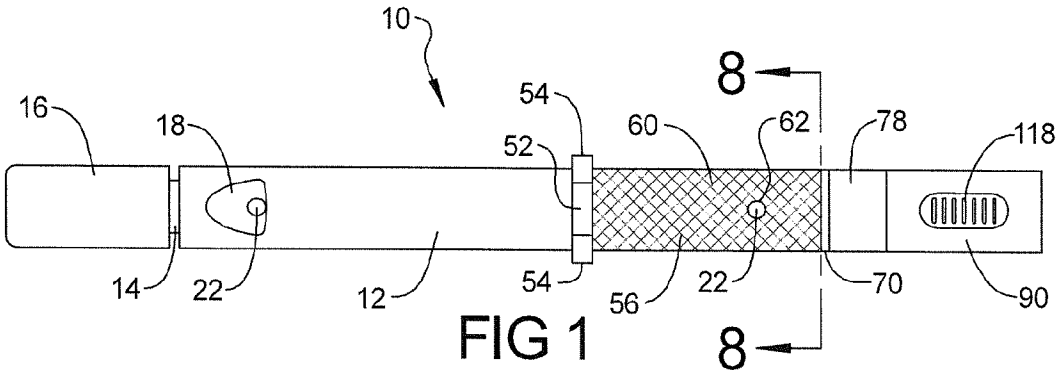
FIG. 1 is a top plan view of one embodiment of a baton constructed in accordance with this disclosure and shown in a closed position.
Figure 2:
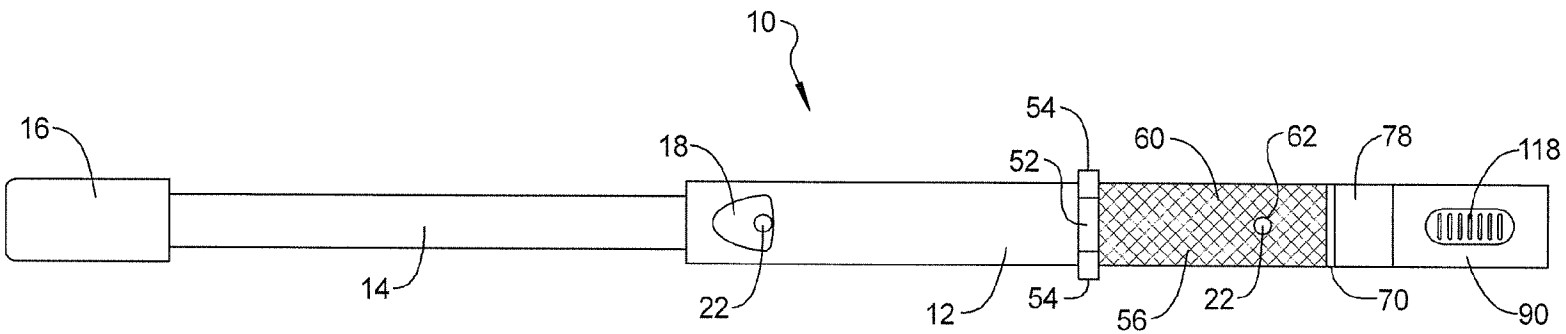
FIG. 2 is a view of the baton of FIG. 1 in an open extended and locked position.
Figure 3:
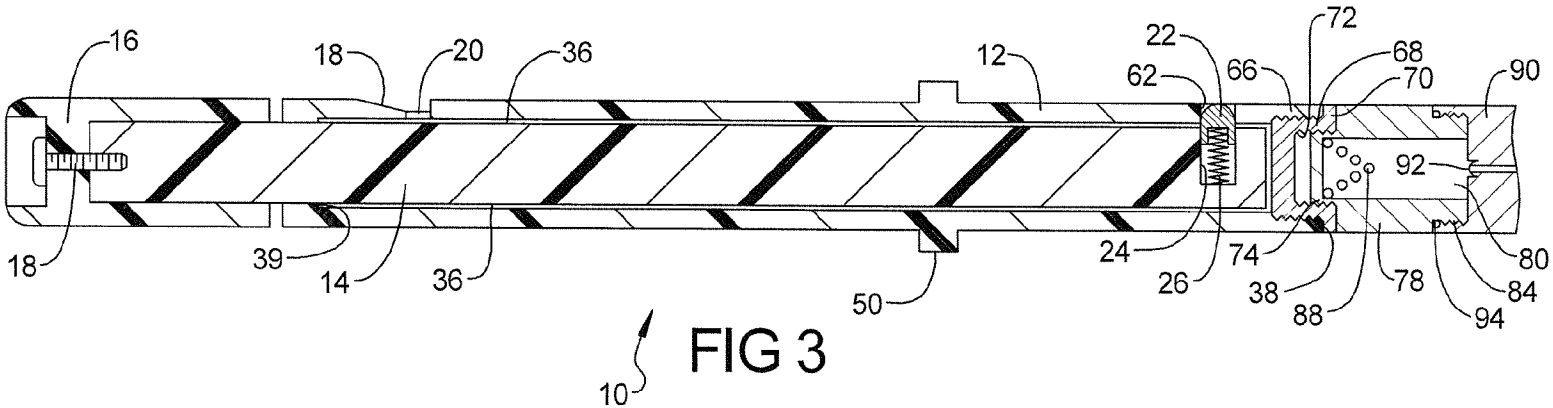
FIG. 3 is a partial side elevation view in axial section taken through the baton of FIG. 1.

A baton 10 suitable for police and law enforcement defense is shown in a storage or closed position in FIG. 1 and in a deployed or open and extended position in FIG. 2. The baton 10 includes a hollow tubular cylindrical body 12 that receives at least a portion of a striking rod or shaft 14. Shaft 14 can be formed of rubber or a polymeric plastic material such as nylon, polypropylene, polyethylene or polycarbonate. Injection molded nylon is preferred A hollow tip 16 formed of rubber or a polymeric material of the type from which the shaft 14 is formed is attached to the front end of the shaft 14, such as with a screw 18 as shown in FIG. 3. Injection molded nylon is a preferred material. The dimensions and weight of the tip 16 and shaft 14 are chosen to reduce the risk of bone breakage yet proved an adequate neuro-muscular impact to incapacitate an assailant.

The combined weight of the tip and shaft are matched with the weight of the remaining components of the baton to provide a balanced feel in both retracted and extended positions. This is achieved by locating the center of gravity of the baton at a point about 14.5 inches (36.8 cm) from the front end of the baton and about 9.5 inches (24.1 cm) from the rear end of the baton in a fully extended position, in one representative example.

In one embodiment, the tip 16 can weigh about one ounce (29 grams), have a length of about two and one half inches (6.5 cm) and an outer diameter of about one and one fourth inch (3 cm). No extra weight needs to be added to the tip 16 to provide any extra striking force. The relatively large size of the tip 16 provides a large impact surface area against one's body so as to reduce the stress and distribute the impact force over a larger area. This reduces the likelihood of breaking bones and causing excessive tissue damage yet provides sufficient impact force and stress to incapacitate an attacker.

The shaft 14 can be about eleven and three quarter inches in length (30 cm) and about seven eighths of an inch in diameter (2 cm). As used throughout herein, the term "about" means plus or minus 10%. With a shaft 14 and tip 16 formed of nylon, their combined weight can be about 0.40 pounds (182 grams).

In one embodiment, the shaft 14 can extend about nine and one half inches (24 cm) from the front end of the body 12. With the tip 16 attached to the shaft 14, the combined fully extended length of the shaft and tip can be about ten inches (25.5 cm) from the front end of the body 12.

The body 12, which can also be formed of rubber or polymeric plastic material of the type noted above, is advantageously formed of injection molded nylon. The combined weight of the body 12, shaft 14 and tip 16, with each formed of nylon, can weigh about 0.6 pounds (330 grams). In one embodiment, the weight of the entire baton, including the flashlight assembly and battery is about 1.15 pounds (523 grams). Nylon is a preferred material for the baton body 12, the shaft 14 and the tip 16 because of its ability to resiliently absorb shock when the baton 10 is used defensively to block a blow from a bat, club, pipe or other type of swinging weapon. This reduces the force transferred to an officer's hands when compared to more rigid metal batons. The same is true when the baton 10 is used in a striking mode.

Figure 4:
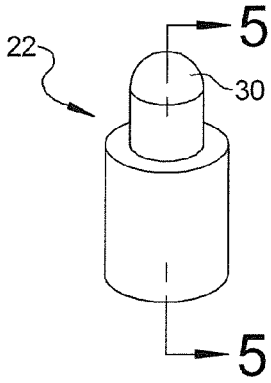
FIG. 4 is a perspective view of a locking and release pin.
Figure 5:
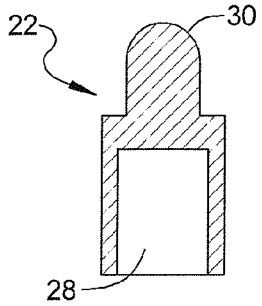
FIG. 5 is a view in section of the locking and release pin taken along section line 5-5 of FIG. 4.

As further seen in FIGS. 1-3, 6 and 9, a recess 18 slopes downwardly and rearwardly into a pocket or through bore 20 formed through a front portion of the wall of the hollow body 12. A spring-biased metal pin 22, described more fully below and shown enlarged in FIGS. 4 and 5, is selectively radially seated in a blind bore 24 (FIG. 3) formed in a rear end portion of the shaft 14. A compression coil spring 26 is also seated in the blind bore 24 and nests within a cylindrical pocket 28 (FIG. 5) formed in the hollow cylindrical base of the metal pin 22.

The metal pin 22 is biased radially outwardly by the coil spring 26 so that the tapered or rounded tip 30 of the metal pin 22 can easily snap into the through bore 20 as the shaft 14 is extended from its retracted position in FIG. 1 to its extended position in FIG. 2.

The radial movement of the metal pin 22 into the through bore 20 securely seats the pin 22 within the through bore 20 and positively locks the shaft 14 in its extended position on the body 12. The shaft 14 can be easily released from this extended position by applying finger or thumb pressure radially inwardly over recess 18 and onto the tip 30 of the metal pin 22 while pushing the shaft 14 axially rearwardly.

Figure 6:
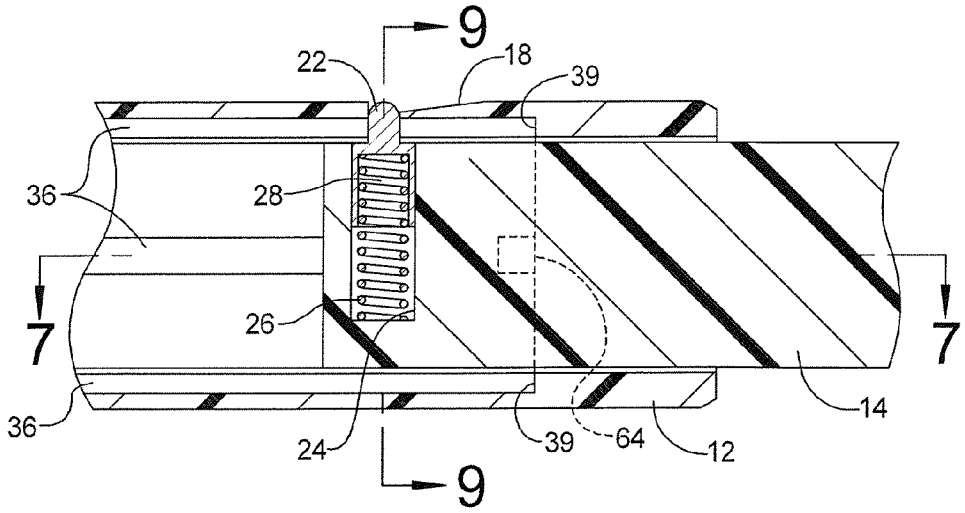
FIG. 6 is a partial side elevation view in axial section showing the baton in a fully extended and locked position.
Figure 7:
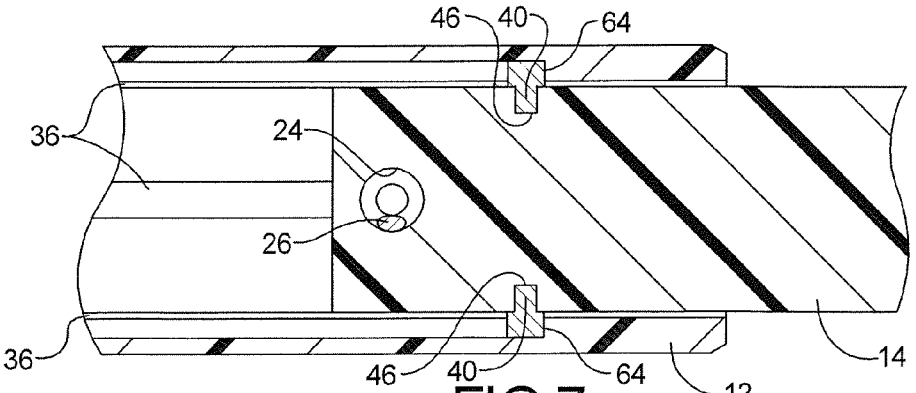
FIG. 7 is a partial top plan view in axial section showing the baton in a fully extended and locked position.
Figure 8:
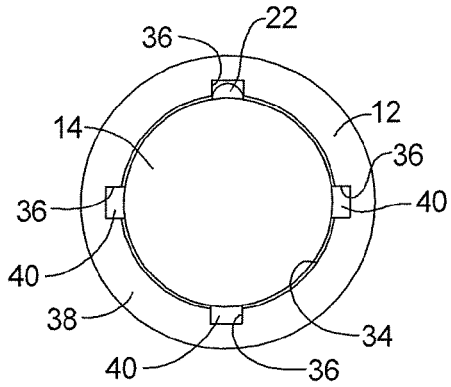
FIG. 8 is an end view of the baton body as seen from section line 8-8 of FIG. 1.

As shown in FIGS. 6, 7 and 8, the inner wall 34 of the hollow body 12 is formed with one or more axially-extending grooves 36. Grooves 36 serve as guideways and slideways for concentrically centering and stabilizing the shaft 14 within the body 12 as the shaft 14 moves between its open and closed positions. The grooves 36 extend from the rear radial end wall 38 of the hollow body 12 up to a blind radial end wall 39 recessed within the inner wall 34 adjacent the front portion of the hollow body 12.

While the spring-loaded metal pin 22 can serve as both a locking and release member as described above, it can also serve as the sole guide member for axially and circumferentially positioning and guiding the shaft 14 within the body 12 as the shaft moves axially within the body 12. This arrangement provides a slideway between the baton body 12 and the shaft 14. However, it has been found that by providing one or more additional guide members circumferentially spaced around the outer surface of the shaft 14, a slideway with a much improved sliding action can be achieved.

That is, by providing a plurality of radially projecting guide members on the shaft 14 and a plurality of matching or complimentary axial grooves along the inner wall of the body 12, a slideway with a very smooth sliding movement can be achieved along with a significant reduction in sliding wear between the shaft 14 and the body 12. Moreover, binding between the shaft 14 and body 12 is virtually eliminated and warpping of the shaft and body is reduced by the support provided by the guide members.

Figure 9:
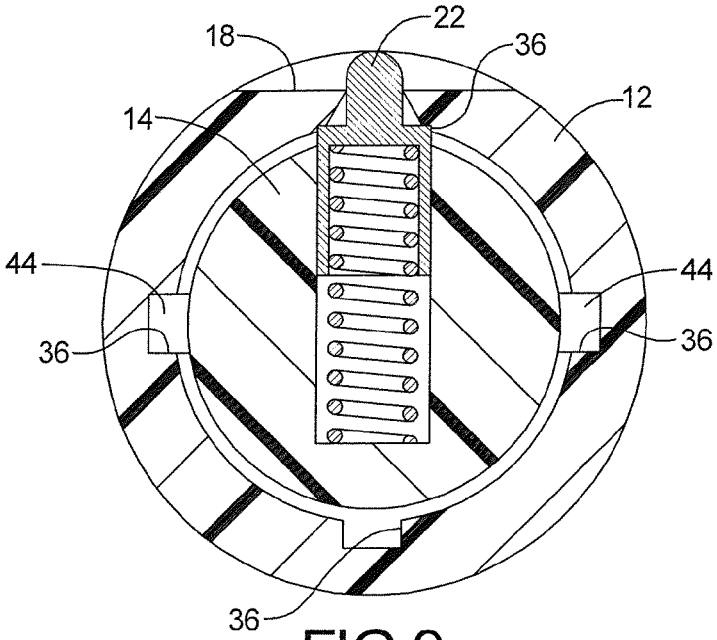
FIG. 9 is a view in radial section taken through line 9-9 of FIG. 6.

While four slideway grooves 36 are shown in the drawings, (see FIGS. 8 and 9), it has been found that three slideway grooves 36 located at the 12 o'clock or "north" position, the 3 o'clock or "east" position and the 9 o'clock or "west" position as seen in FIG. 9, provide adequate coaxially centered guidance and improved sliding performance between the baton body 12 and the shaft 14. That is, the groove 36 located at the 6 o'clock or "south" position shown in FIG. 8 is optional. Of course, the grooves 36 need not be evenly spaced around the inner surface of the body 12, although even spacing does provide a more balanced and even sliding action.

Figure 10:
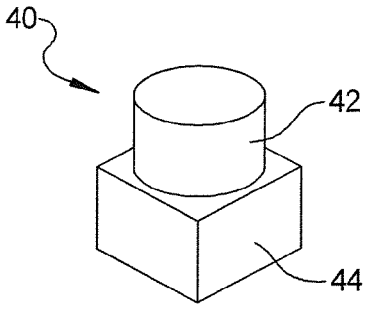
FIG. 10 is a perspective view of a guide member.

One embodiment of a guide member adapted for sliding within a groove 36 is shown in FIG. 10. In this example, the guide member takes the form of a solid metal peg 40 having a cylindrical shaft 42 and a square or rectangular head 44. The shaft 42 is dimensioned to fit closely or snugly within a blind cylindrical bore 46 (FIG. 7) formed in the rear end portion of the shaft 14. Although the shaft 42 fits closely within a bore 46 with a very light friction fit, the shaft 42 can frictionally rotate within the bore 46 to provide self alignment between the rectangular head 44 and the sidewalls of each groove 36 as the shaft 14 slides within the baton body 12.

Each groove 36 can be formed with any contour that matches the contour of the head 44. In the examples shown, grooves 36 are formed with a generally rectangular cross section which closely matches the cross section of each head 44. This provides a type of "tongue and groove" slideway between the shaft 14 and the body 12.

Of course, the arrangement of guide members and grooves can be reversed. In this case, the grooves 36 can be formed along the shaft 14 and the guide members 40 can be provided on the inner wall of the body 12.

As further seen in FIGS. 1, 2 and 3, a plastic grip stop 50 is molded homogeneously with the plastic body 12. The grip stop 50 is formed as an annular radial flange. Flat portions 52 can be formed in the circular surface 54 of the grip stop 50 to prevent the baton 10 from rolling on an inclined surface. The grip stop 50 also helps an officer position a handhold on the baton to locate a flashlight switch as discussed further below.

A hand grip 56 is formed on a rear portion of the body 12 rearwardly of the grip stop 50. The hand grip 56 can be provided with a textured surface 60 such as by checkering or knurling. A through bore 62 is formed through the hand grip portion 56 of the body 12 to selectively receive the pin 22 as shown in FIG. 3. The spring 26 is designed to provide adequate retention force of the pin 22 within the through bore 62 to retain the shaft 14 in a retracted position, but not so much force as to inhibit deployment of the shaft 12 with a quick snap of one's wrist. In this manner, the through bore 62 provides a storage position of the shaft 14 in its fully retracted position while it is nested concentrically within the baton body 12.

In the fully extended position of the shaft 14 as shown in FIGS. 6 and 7, the pin 22 positively seats within the through bore 20 at substantially the same time that the leading edges 64 of the peg heads 44 abut the radial end walls 39 of their respective guide grooves 36. This provides a robust feel of a positive and secure retention of the shaft 14 in it's fully extended position. This abutment also prevents any damage to or excessive wear on the pin 22 and the through bore 20 and results in a loud alarming snapping or cracking noise. It should be noted that the shaft 14 can also be drawn out of the body 12 by simply griping the tip 16 and pulling it outwardly as one would draw a sword from a scabbard.

Returning to FIG. 3, it can be seen that the rear end portion of the baton body 12 has an internally threaded inner wall portion 66 that receives an externally threaded metal adaptor plug 68. The pitch of this threaded connection is preferably coarse to prevent stripping between the metal and plastic threads. The adaptor plug 68 includes an annular radial flange 70 which abuts the radial end wall 38 of the body 12. The adaptor 68 is formed with an internally threaded bore 72 for receiving the forward threaded end portion 74 of a metal coupling 78.

Figure 11:
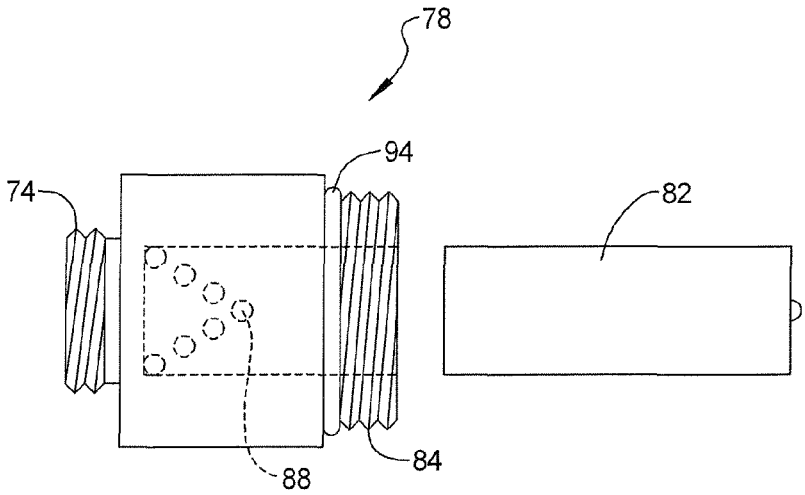
FIG. 11 is a side elevation view of a flashlight coupling and battery holder.
Figure 12:
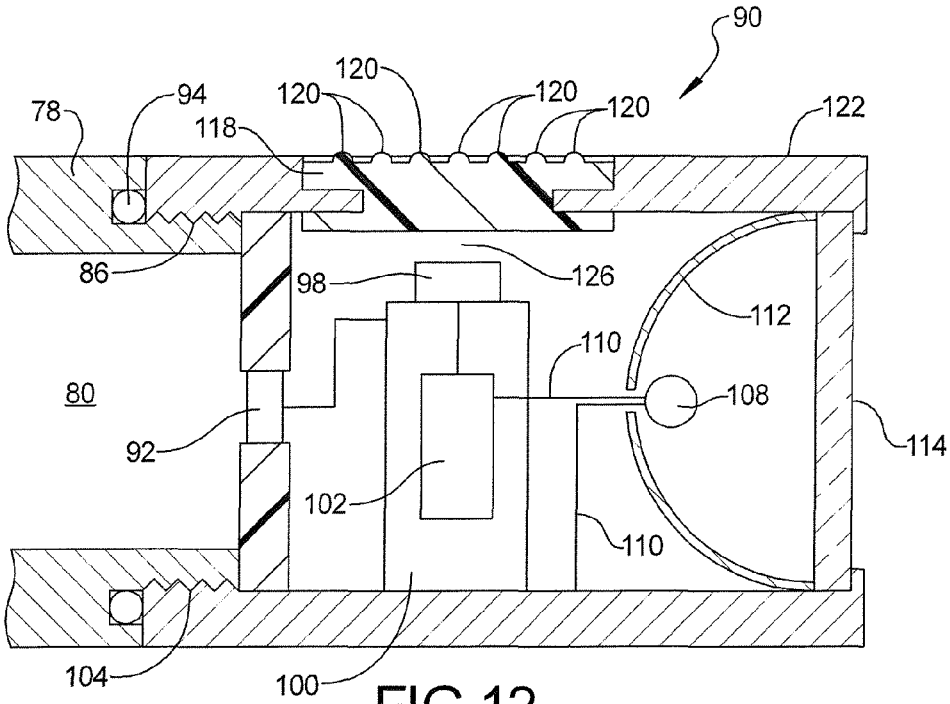
FIG. 12 is a side elevation view in section of a flashlight assembly.
Figure 13:
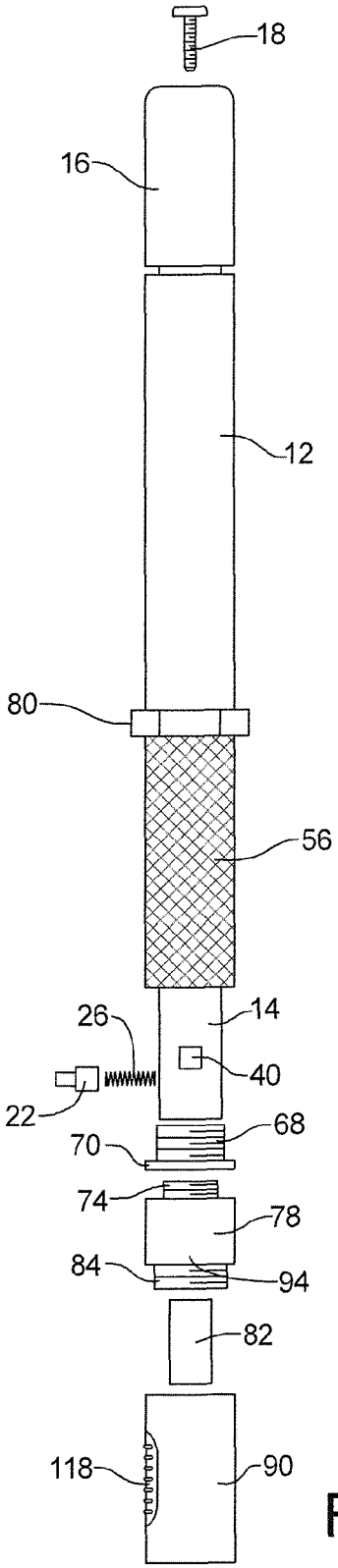
FIG. 13 is an exploded view of the baton of FIGS. 1 and 2.

As shown in FIGS. 11 and 12, the metal coupling 78 is formed with a cylindrical central pocket 80 for housing at least a portion of a battery 82. A conical metal spring 88 is positioned in the pocket 80 to provide a biased electrical contact with the battery 82 and coupling 78. The rear end portion of the metal coupling has a hollow threaded sleeve 84 that threads into an internally threaded pocket 86 (FIG. 12) formed in a removable flashlight assembly 90. While a removable threaded coupling between the flashlight body 12 is shown, other types of connections can be used such as bayonet connections and other releasable connections. A seal, such as an O-ring 94, can be provided between the coupling 78 and the flashlight assembly 90 to prevent water from entering the flashlight assembly and damaging its logic circuits.

As further seen in FIG. 12, the cylindrical flashlight assembly 90 includes a battery contact 92 for receiving power from a single battery 82, such as a common 3 volt lithium battery of the type used in cameras. When the coupling 78 and flashlight assembly 90 are screwed together, electrical contact is made between the battery 82 and the battery contact 92. An electrical lead 96 from the contact 92 delivers battery power to a button switch 98 mounted on a circuit board 100.

One or more logic circuits, ASICS or other integrated or discrete circuits as represented by a "chip" 102 are mounted on the circuit board 100 and powered through selective actuation of the button switch 98. The metal coupling 78 and the metal tubular body 104 of the flashlight assembly 90 serve as an electrical lead or ground for completing a circuit between the battery 82 and one or more light emitters 108 via electrical leads 110. The light emitters 108 are controlled by the logic circuits or chip 102 to provide selective illumination modes as discussed below. The light emitters 90 can be light emitting diodes (LEDs), incandescent bulbs, ultraviolet LEDs, infrared light emitters or virtually any other emitter of electromagnetic waves. A parabolic silvered textrued reflector 112 helps to flatten the light to eliminate rings and hot spots. A lens 114 covers and seals the rear end of the flashlight body.

As further seen in FIG. 12, a radially-depressable rubber or elastomeric switch cover 118 is mounted on the hollow metal body 104 of the flashlight assembly 90. The elastic switch cover 118 is positioned flush with or slightly below the outer cylindrical surface of the metal body 104. Small ribs 120 on the switch cover 118 can extend above the outer surface 122 of the metal body 102 to provide a tactile locator for operating the button switch 98. A small radial gap 126 can be provided between the inner surface of the rubber switch cover 118 and the top of the button switch 98 to minimize or prevent the unintended actuation of button switch 82 by the palm of one's hand when gripping the metal body 104. The flush or recessed position of the switch cover 118 further reduces the likelihood of unintended activation of the button switch 82.

In one example, button switch 98 is constructed to latch the light emitter 108 on or off with a long radial throw or depression of the switch cover 118 and button switch 98 and to alternatively provide a momentary actuation of light emitter 108 with a partial, shorter, non-latching radial throw or depression of the switch cover 118 and button switch 98. When latching the button switch 98 on or off with a long radial throw of switch over 118, an audible click can be heard as produced from the button switch 98. However, when the button switch 98 is activated with a momentary partial radial depression of the switch cover 118, the light emitter 108 can be cycled through a series of operating modes without any audible sound. This can be most beneficial when conducting silent investigative work, when it is desired to conceal one's presence.

The logic chip 102 can be programmed to produce any number of different operating illumination modes, such as a high intensity light beam, a low intensity light beam and a strobed light beam as well as an on-off function. In one embodiment, the logic chip 80 is programmed to step serially through a sequence of high intensity light, low intensity light, a high intensity strobed light from emitter 90 and then back to high intensity light in a repetitive sequence. This sequence can be achieved by serially switching the button switch 98 in a fully latched on and a fully latched off position from each operating mode.

Alternatively, the various operating modes of the flashlight assembly may be cycled serially by turning on the emitter 108 from an off mode to any one of the operating modes with a long latching throw of switch cover 118. The operating mode that is actuated from the off position can be set by the logic chip 80 to any one of the operating modes or can simply be the next mode after the last operating mode selected in a fixed series of illumination operating modes.

That is, each time the emitter 108 is turned on, the logic chip 102 can be programmed to turn on the emitter 108 in a steady high intensity mode and then cycle through a low intensity mode, or strobed mode and back to a high intensity mode. Alternatively, if the emitter 108 is turned off in any of the operating modes, the next time the emitter is turned on, it will be turned on in the next operating mode in the sequence and then cycle through the modes in a fixed cycle.

The chip 102 can be programmed to cycle through a sequence of operating modes by first latching the emitter on and then cycling through each following mode by silently depressing and releasing the switch cover 118 and button switch 98 with a partial radial throw or depression of the switch cover and button switch. Upon release of the partially actuated switch cover and button switch, the next operating mode in a fixed cycle or sequence of operating modes will continue until another partial throw of the button switch cycles the emitter 90 to the next mode or a full latching throw turns off the emitter.

It should be noted that while the plastic baton 10 is of a relatively light construction, the flashlight assembly 90 is of a heavier and denser metal construction. A softer plastic coating or housing can be provided over the metal flashlight assembly 90 to provide a softer external surface. However, in an emergency, the harder and heavier metal body 104 of the flashlight assembly 90 can be used for effective self defense.

Figure 14:
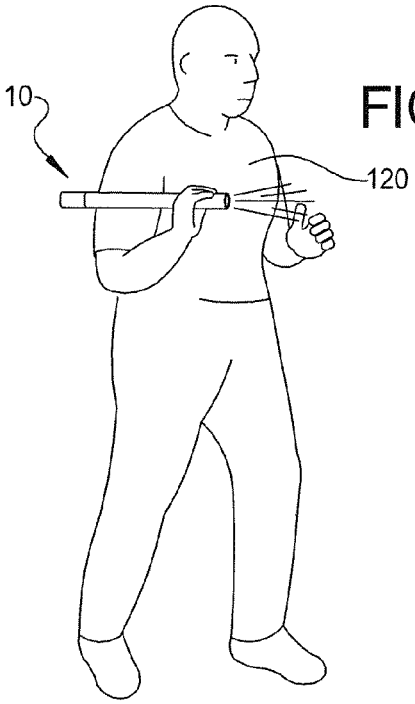
FIG. 14 is a schematic view of a person using the baton of FIG. 1 as a flashlight.

The combined functions of a flashlight and baton as described above provide advantages not previously achievable with conventional batons and flashlights. In particular, by locating the flashlight switch in a rear portion of the baton (about one inch to two inches (2.54 cm to 5.1 cm) from the rear end of the flashlight (e.g. from the flashlight lens), a person such as a police officer 120 can grip the hand grip 56 of the baton 10 as shown in FIG. 14. This is the standard grip used by police officers when using a conventional duty flashlight.

Figure 15:
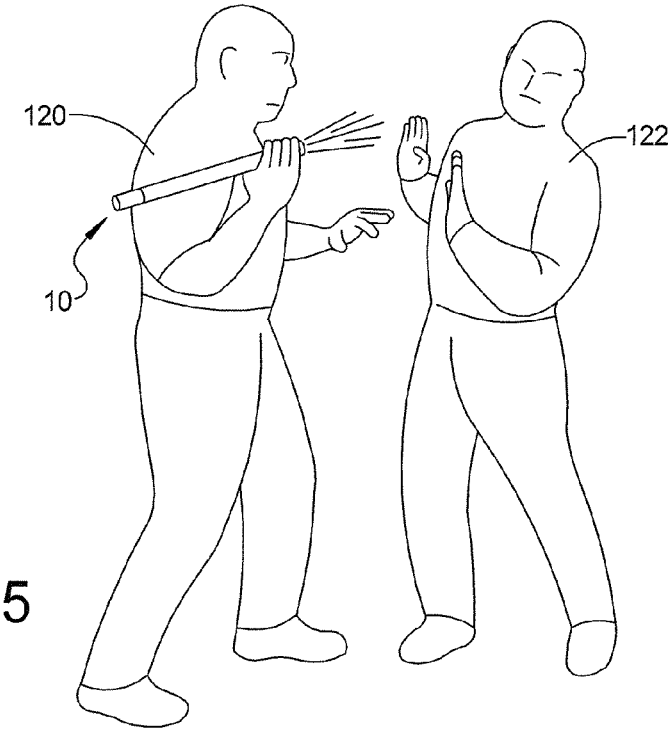
FIG. 15 is a view of the person of FIG. 14 shining the flashlight in an assailant's eyes.
Figure 16:
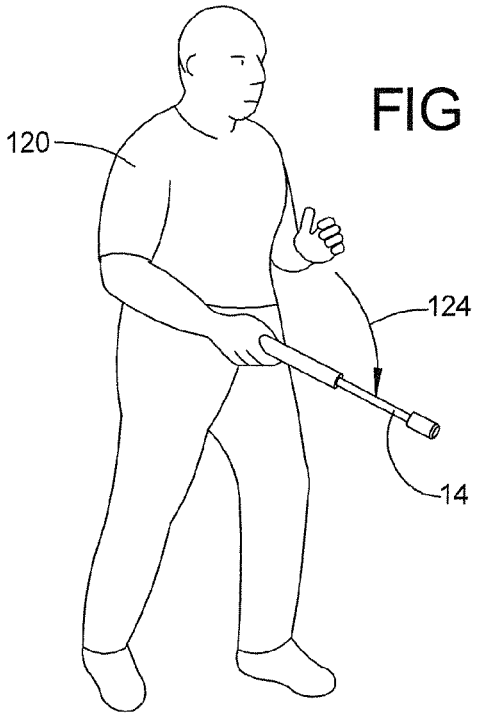
FIG. 16 is a view of the person of FIG. 15 deploying the baton.

In this position, the officer's index finger or thumb is naturally positioned over the switch cover 118 for easy actuation of the button switch 98 and selection of a flashlight operating mode. For example, as seen in FIG. 14, an officer 120 can initially carry the baton 10 in a closed position using the baton 10 as a conventional flashlight in either a high or low constant intensity light operating mode. If the officer 120 detects a potential assailant 122 (FIG. 15), the officer can order the potential assailant to stand down. If the assailant refuses to follow the officer's instructions, the officer can switch the flashlight to a strobed mode as shown in FIG. 15. The high intensity strobed light visually stuns and disorients the potential assailant and gives the officer time to deploy the baton with a simple forward flick of the wrist and/or a quick extension of the forearm. This movement is represented in FIG. 16 by directional arrow 124. This release, extension and locking of the baton shaft 14 in an extended position produces a loud audible snapping or "racking" noise which additionally distracts and alarms the potential assailant.

Figure 17:
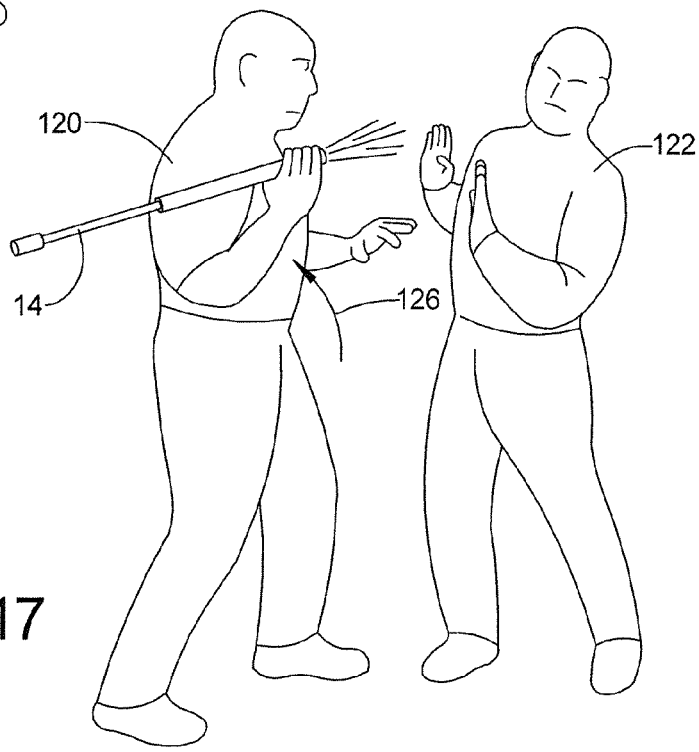
FIG. 17 is a view of the person of FIG. 16 shining the flashlight in the eye's of an assailant with the baton deployed in an extended position.

The officer can then position the baton 10 in a self defense position as shown in FIG. 17 by moving the forearm upwardly and back to the general position shown in FIG. 15 as represented by directional arrow 126 in FIG. 17. This will result in the officer 120 continuing to shine the high intensity strobed light from the flashlight into the eyes of the potential assailant as further seen in FIG. 17, but with the added protection of having a deployed baton in position for striking the assailant, if necessary. While the above procedure has been described with use of a strobed light it can also be carried out with a constant high intensity light. However, a strobed light provides a far greater visually stunning and disorienting effect than a constant light. Thus, the integral combination of a strobed light and baton provides a level of less than lethal defense not previously available.

It will be appreciated by those skilled in the art that the above baton light is merely representative of the many possible embodiments of the invention and that the scope of the invention should not be limited thereto, but instead should only be limited according to the following claims.

What is claimed is:

1. A baton comprising:

a hollow baton body;

a baton shaft comprising a polymeric material and at least partially telescopically disposed within said hollow baton body; and a slideway provided between said hollow body and said baton shaft comprising at least one axial groove and at least one guide member extending into and movable along said at least one axial groove, said guide member comprising a rotatable guide member which self aligns within said at least one axial groove as said shaft slides within said hollow baton body.

2. The baton of claim 1, further comprising a flashlight coupled to said hollow baton body.

3. The baton of claim 2, wherein said flashlight comprises a strobed light operating mode.

4. The baton of claim 1, wherein said hollow baton body comprises a plastic material.

5. The baton of claim 1, wherein said baton shaft comprises a plastic material.

6. The baton of claim 1, further comprising a plastic tip coupled to said baton shaft.

7. The baton of claim 6, wherein said plastic tip comprises a hollow cylindrical plastic tip.

8. The baton of claim 6, wherein said plastic tip has an outer diameter of about 3 centimeters.

9. A baton, comprising: a hollow baton body; a baton shaft comprising a polymeric material and at least partially telescopically disposed within said hollow baton body, said baton shaft having a front end portion; a hollow tip comprising a rubber or polymeric material attached to said front end portion of said shaft with said front end portion of said shaft fitted within said hollow tip; and at least three slideways provided said hollow body and said baton shaft each comprising an axial groove and a guide member extending into said axial groove, said slideways being circumferentially disposed at nine, twelve and three o'clock positions around said hollow body and said baton shaft.

10. The baton of claim 9, wherein said hollow baton body and said baton shaft are formed of a plastic material.

11. The baton of claim 10, wherein said plastic material comprises a nylon material.

12. The baton of claim 9, further comprising a flashlight coupled to said baton body and wherein said flashlight comprises a flashlight body and an elastic radially movable switch cover provided substantially flush upon said flashlight body and an on-off switch provided within said flashlight body.

13. The baton of claim 12, wherein said on-off switch is radially spaced apart from said elastic switch cover without contacting said switch cover.

14. A method of using a baton having a hollow body provided with a radial flange serving as a grip stop and a textured hand grip portion, and baton shaft comprising polymeric material and at least partially telescopically disposed within said hollow body, and a flashlight coupled to said hollow body, said flashlight comprising a switch cover positioned adjacent an on-off flashlight switch, and at least three slideways provided said hollow body and said baton shaft each comprising an axial groove and a guide member extending into said axial groove, said slideways being circumferentially disposed at nine, twelve and three o'clock positions around said hollow body and said baton shaft; wherein said method comprises:

gripping said flashlight around said hand grip portion;

locating said switch cover using said radial flange and said hand grip to position a finger or thumb over said switch cover;

turning on said flashlight with said switch cover and said on-off flashlight switch;

shining the flashlight on a person with the baton shaft in a retracted position within the hollow body;

extending the baton shaft from the hollow body with a downward movement of one's forearm and wrist; and shining the flashlight in a person's eyes with the baton shaft extending from the hollow body by lifting one's forearm in and wrist upwardly.

15. The method of claim 14, wherein the flashlight has a strobed light operating mode and said shining the flashlight in a person's eyes further comprises shining a strobed light in the person's eyes.

16. A baton, comprising:

a hollow body having a radial flange serving as a grip stop and a textured hand grip portion adjacent said radial flange;

a baton shaft comprising a polymeric material at least partially telescopically disposed within said hollow body; and at least three slideways provided said hollow body and said baton shaft each comprising an axial groove and a guide member extending into said axial groove, said slideways being circumferentially disposed at nine, twelve and three clock positions around said hollow body and said baton shaft;

a flashlight coupled to said hollow body;

an on-off switch cover provided on said flashlight;

an on-off switch carried by said flashlight adjacent said on-off switch cover; and wherein said grip stop and said textured hand grip portion serve as a tactile locator to position a user's hand on said flashlight such that a user's finger or thumb is positioned over said switch cover when said user's hand grips said textured hand grip portion adjacent said grip stop.

* * * * *